United States Patent [19]

Kroener

[11] Patent Number: 4,626,109

[45] Date of Patent: Dec. 2, 1986

[54] WATCH HAND DRIVE SHAFT STRUCTURE

[75] Inventor: Wolfgang Kroener, Pforzheim, Fed. Rep. of Germany

[73] Assignee: Pforzheimer Uhren Rohwerke Porta GmbH, Pforzheim, Fed. Rep. of Germany

[21] Appl. No.: 807,456

[22] Filed: Dec. 10, 1985

[30] Foreign Application Priority Data

Dec. 10, 1984 [DE] Fed. Rep. of Germany ... 8436089[U]

[51] Int. Cl.[4] ..... G04B 29/00

[52] U.S. Cl. ..... 368/322

[58] Field of Search ..... 368/76, 80, 220, 223, 368/322, 323

[56] References Cited

U.S. PATENT DOCUMENTS 4,249,251 2/1981 Wuthrich ..... 368/322

FOREIGN PATENT DOCUMENTS 291260 6/1953 Switzerland ..... 368/322
298561 5/1954 Switzerland ..... 368/322
244195 5/1969 U.S.S.R. ..... 368/322

*Primary Examiner*—Vit W. Miska

[57] ABSTRACT

In a drive shaft arrangement for a timepiece provided with a minute shaft for carrying a minute hand and an hour sleeve disposed on the minute shaft for carrying an hour hand, the minute shaft is provided with a collar and carries on one side of the collar a minute gear and a pinion gear for rotation with the minute shaft and on the other side the hour sleeve which is provided with an hour gear. The hour gear has a pan-shaped cavity formed in its face adjacent the collar and a Belleville spring is disposed in the pan-shaped cavity so as to abut with its outer circumference the cavity wall and with its radially inner end the collar.

2 Claims, 1 Drawing Figure

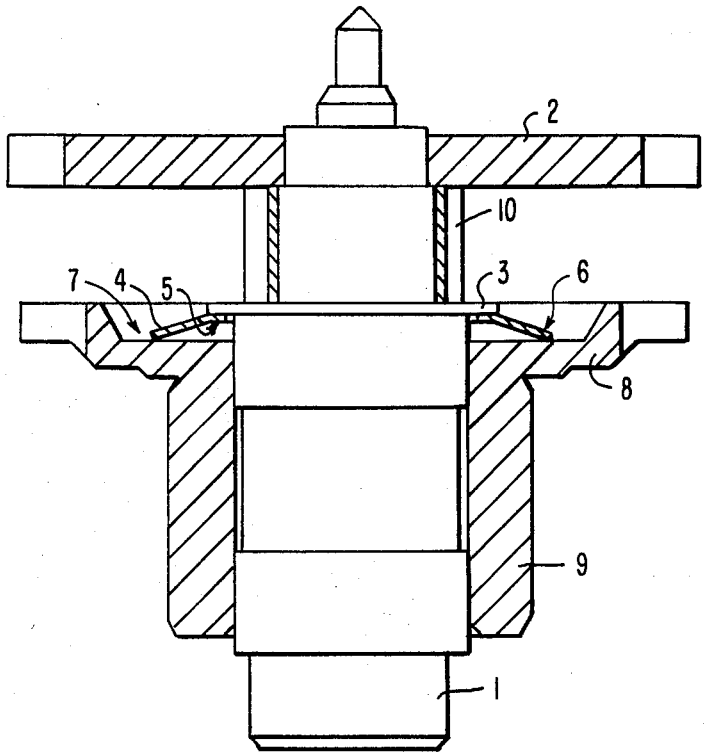
2
10
7
4
5
3
6
8
9
1

WATCH HAND DRIVE SHAFT STRUCTURE

BACKGROUND OF THE INVENTION

The invention relates to a drive shaft structure for the minute and hour gears of a timepiece, especially a wristwatch which includes a Belleville spring disposed between two gears.

A wristwatch including such drive shaft structure is well-known in the prior art.

Especially quality watches usually have such drive shaft structures with Belleville springs between the two radial gears in order to take up any play between the two gears and the associated pinion gears. The two radial faces are usually formed by the side surface of the gear as far as the hour gear is concerned and by the side surface of a collar formed on the pinion gear or by a washer disposed on the shaft adjacent the pinion gear. Modern manufacturing of such watch operating mechanisms requires not only miniaturization of the various parts of such mechanisms but these parts should also be adapted to be manufactured by robots and assembled automatically. For miniaturization a collar of relatively large diameter to be provided on the pinion gear is objectionable so that generally the mounting of a washer onto the minute gear shaft is preferred. The sliding of such a washer onto the ger shaft however requires an additional assembly step during manufacturing of the watch and therefore increases assembly time and increases the manufacturing cost.

It is therefore the principal object of the present invention to provide such a watch hand drive arrangement which is small in volume for the required miniaturization and which permits omission of the washer and, of course, of the step of assembling such washer.

SUMMARY OF THE INVENTION

A drive shaft arrangement for a timepiece such as a watch includes a minute shaft for carrying the minute hand which is provided with a collar and has a minute gear and pinion gear mounted thereon at one side of the collar and an hour sleeve with an hour gear rotatably disposed thereon at the other side of the collar. The hour gear has a cavity formed in its face adjacent the collar and a Belleville spring is disposed in the cavity with its radially outer end abutting the cavity wall and its radially inner end abutting the collar to take up any play.

Preferably the cavity has a conical circumferential end wall to form a pan-shaped cavity which properly locates the Belleville spring and greatly facilitates automatic assembly of the drive shaft arrangement.

With the arrangement according to the invention the Belleville spring may simply be placed into the cavity in the hour gear where, with the conical side walls of the cavity it will position itself properly automatically while abutting the collar on the minute hand shaft, the pinion gear being pressed onto the minute hand shaft from the other side of the shaft until it abuts the collar from the opposite side. This not only permits omission of a washer but, more importantly, omits the step of placing the small washer onto the shaft. The arrangement also facilitates mounting of the Belleville washer as it is properly positioned by its reception in the cavity, and, furthermore reduces the space required therefore because of the reception of the Belleville spring in a cavity.

SHORT DESCRIPTION OF THE DRAWINGS

The sole FIGURE shows a watch hand drive and support shaft arrangement according to the invention.

DESCRIPTION OF THE PREFERRED EMBODIMENT

As shown in FIG. 1, shaft 1 carrying the minute hand (not shown) carries at its other end a minute gear 2. In an intermediate area it has a collar 3 formed thereon and extends through a sleeve 9 rotatably disposed on the shaft 1 and being provided with an hour gear 8. The hour gear 8 has a pan-like cavity 7 formed therein in which cavity a Belleville spring 6 is disposed abutting the cavity wall with its circumferential edge 6 and the collar 3 with its radially inner edge 5. On the side of the collar 3 opposite the spring 6 the shaft 1 carries a pinion gear 10 mounted thereon for rotation therewith and with the minute gear 2.

During operation, the minute gear is driven by a gear drive (not shown) at 1 rph so that the minute hand carried at the other end of shaft 1 moves around once each hour. A gear structure (not shown) consisting of a gear in engagement with the pinion gear 10 and another gear in engagement with the hour gear 8 provides for a speed reduction of 12 to 1 so that the gear 8 and the sleeve 9 carrying the hour hand rotate once every 12 hours.

I claim:

1. A drive shaft arrangement for a timepiece, comprising a minute shaft adapted to carry a minute hand at one end thereof, said minute shaft having a collar formed thereon and carrying a minute gear at its other end, a pinion gear disposed on said minute shaft between said collar and said minute gear for rotation therewith, an hour gear provided with a sleeve rotatably disposed on said minute shaft at the side of said collar opposite said pinion gear, said hour gear having a cavity formed in its face adjacent said collar and a Belleville spring disposed in said cavity and having its radially inner end disposed adjacent said collar and its radially outer end abutting the cavity wall.

2. A drive shaft arrangement according to claim 1, wherein said cavity is formed so as to have a conical outer wall section adapted to center said Belleville spring when introduced into said cavity.

* * * * *